US010122086B2

(12) United States Patent
Kuroda et al.

(10) Patent No.: US 10,122,086 B2
(45) Date of Patent: Nov. 6, 2018

(54) ANTENNA DEVICE AND COMMUNICATION APPARATUS

(71) Applicant: Murata Manufacturing Co., Ltd., Kyoto (JP)

(72) Inventors: Katsuhito Kuroda, Kyoto (JP); Kengo Onaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 9 days.

(21) Appl. No.: 15/585,439

(22) Filed: May 3, 2017

(65) Prior Publication Data

US 2017/0237168 A1 Aug. 17, 2017

Related U.S. Application Data

(63) Continuation of application No. PCT/JP2015/080476, filed on Oct. 29, 2015.

(30) Foreign Application Priority Data

Nov. 14, 2014 (JP) ..... 2014-231888

(51) Int. Cl.
*H01Q 9/14* (2006.01)
*H01Q 1/24* (2006.01)
(Continued)

(52) U.S. Cl.
CPC ..... *H01Q 5/321* (2015.01); *H01Q 1/242* (2013.01); *H01Q 5/328* (2015.01); *H01Q 9/145* (2013.01)

(58) Field of Classification Search
CPC ..... H01Q 5/321; H01Q 5/328; H01Q 9/14; H01Q 9/145; H01Q 1/242; H01Q 1/24
See application file for complete search history.

(56) References Cited

U.S. PATENT DOCUMENTS 8,736,509 B2 * 5/2014 Shoji ..... H01Q 5/00 343/860
2002/0017980 A1 2/2002 Uozumi
(Continued)

FOREIGN PATENT DOCUMENTS

JP 2001-185938 A 7/2001
JP 2001-344574 A 12/2001
(Continued)

OTHER PUBLICATIONS

International Preliminary Report on Patentability issued in Patent Application No. PCT/JP2015/080476 dated May 16, 2017.
(Continued)

*Primary Examiner* — Hoang Nguyen
(74) *Attorney, Agent, or Firm* — Pearne & Gordon LLP

(57) ABSTRACT

In an antenna device including a high-band antenna element and a low-band antenna element that are connected to a common feed point and feeding electric power using one feed point, influence by unnecessary resonance of the low-band antenna element in a high band is suppressed. The antenna device includes a high-band antenna element and a low-band antenna element that are connected to a common feed point, an antenna-shortening inductor that is connected to between the low-band antenna element and the feed point, and a capacitor that is connected to the antenna-shortening inductor in parallel.

15 Claims, 11 Drawing Sheets

(51) Int. Cl.
*H01Q 5/321* (2015.01)
*H01Q 5/328* (2015.01)

(56) References Cited

U.S. PATENT DOCUMENTS

| | | | | |
|---|---|---|---|---|
| 2003/0034917 | A1 | 2/2003 | Nishizawa et al. | |
| 2009/0322618 | A1 | 12/2009 | Shoji | |
| 2012/0056795 | A1* | 3/2012 | Nagumo | H01P 5/02 343/787 |
| 2013/0194149 | A1* | 8/2013 | Kimura | H01Q 1/2225 343/803 |
| 2013/0201071 | A1* | 8/2013 | Uchida | H01Q 5/0041 343/820 |

FOREIGN PATENT DOCUMENTS

| | | | |
|---|---|---|---|
| JP | 2005-045646 | A | 2/2005 |
| JP | 2006-067234 | A | 3/2006 |
| JP | 2010-010960 | A | 1/2010 |
| JP | 2014-146851 | A | 8/2014 |

OTHER PUBLICATIONS

International Search Report Issued in Patent Application No. PCT/JP2015/080476 dated Dec. 1, 2015.
Written Opinion Issued in Patent Application No. PCT/JP2015/080476 dated Dec. 1, 2015.

* cited by examiner

FIG. 8A
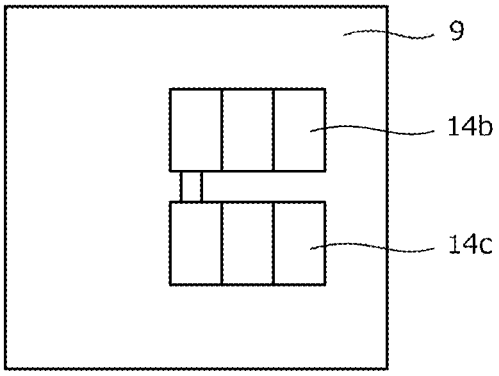
FIG. 8B
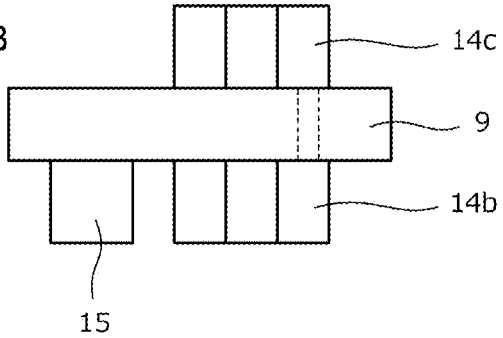
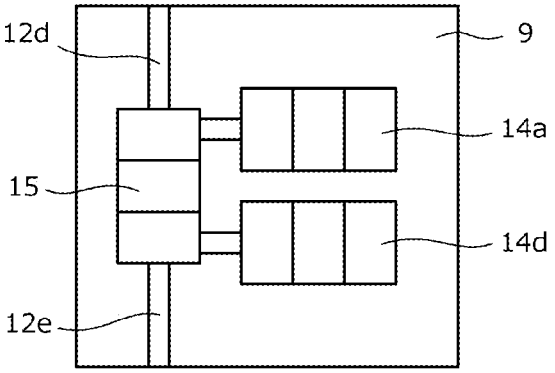
FIG. 8C
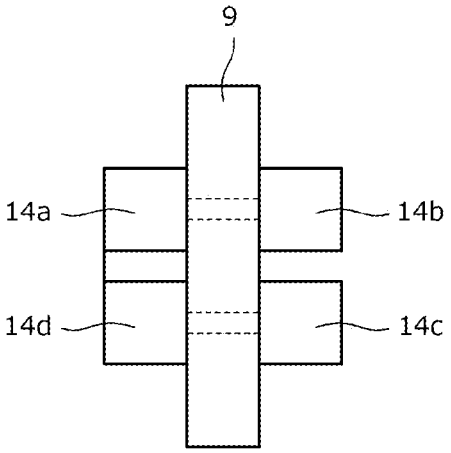
FIG. 8D

ANTENNA DEVICE AND COMMUNICATION APPARATUS

This is a continuation of International Application No. PCT/JP2015/080476 filed on Oct. 29, 2015 which claims priority from Japanese Patent Application No. 2014-213888 filed on Nov. 14, 2014. The contents of these applications are incorporated herein by reference in their entireties.

BACKGROUND

Technical Field

The present disclosure relates to an antenna device compatible with multiple bands, which is configured by connecting a high-band antenna element and a low-band antenna element at one feed point, and a communication apparatus including the antenna device.

There is a method in which an antenna element length is shortened with an inductor as an existing technique of providing a wideband antenna. For example, Patent Document 1 discloses that a resonant frequency of an antenna is varied by connecting a tapped inductor to an antenna element, enabling a tap to be selected by a switch, and switching a shortening rate of the antenna element with the selection of the tap.

There is a method in which electric power is fed to an antenna compatible with a plurality of bands using a common feed point as one technique of making the antenna operable in multiple bands. For example, Patent Document 2 discloses a dual band antenna having a single feed point and having a what-is-called bifurcate structure, which is operable in two bands. In the antenna device disclosed in Patent Document 2, an impedance matching portion is inserted and connected between an end portion of an antenna element for a high-frequency band at the feed point side and an open end portion thereof.

Patent Document 1: Japanese Unexamined Patent Application Publication No. 2001-344574

Patent Document 2: Japanese Unexamined Patent Application Publication No. 2010-10960

BRIEF SUMMARY

In recent years, a terminal-side antenna is required to achieve band widening, in particular, at the low band side (hereinafter, referred to as "low band") while a frequency band of a cellular phone is increasingly widen. However, an installation space of an antenna that is mounted on a cellular phone terminal is extremely limited and the antenna at the low band side needs to achieve band widening while being reduced in size. Furthermore, the antenna has to be compatible with the high band side (hereinafter, "high band") and electric power is therefore fed by one feed by connecting a low-band antenna element and a high-band antenna element, in general.

In the antenna device disclosed in Patent Document 1, a shortening rate of the antenna element can be switched by switching an inductance value with a switch or the like. When this configuration is applied to the low-band antenna element and the high-band antenna element is connected to the low-band antenna element for feeding electric power by one feed, the low-band antenna element is excited by ¾ wavelength resonance (hereinafter, referred to as "¾λ-resonates") with a high-band frequency in some cases. Loss is generated in the low-band antenna element with the ¾λ resonance of the low-band antenna element, resulting in deterioration in antenna efficiency in the high band.

In the antenna device disclosed in Patent Document 2, the high-band antenna element and the low-band antenna element are connected to the common feed point and an LC resonance circuit is inserted into the high-band antenna element. The LC resonance circuit is capacitive in a high band and the high-band antenna element resonates in the high band. The above-described LC resonance circuit is inductive in a low band and the high-band antenna element resonates in the low band. That is to say, the high-band antenna element is caused to resonate in both of the high band and the low band to try to achieve band widening in the low band. Even with this configuration, the low-band antenna element is also excited by the ¾λ resonance in the high band and deterioration in efficiency in the high band cannot be prevented.

The present disclosure provides an antenna device including a high-band antenna element and a low-band antenna element that are connected to a common feed point, feeding electric power using one feed point, which suppresses influence by unnecessary resonance of the low-band antenna element in a high band. Furthermore, the present disclosure provides a communication apparatus including the antenna device.

(1) An antenna device according to an aspect of the present disclosure includes:

a high-band antenna element and a low-band antenna element that are connected to a common feed point;

an inductor for shortening the antenna element (hereinafter, "antenna-shortening inductor") that is connected to between the low-band antenna element and the feed point; and a capacitor that is connected to the antenna-shortening inductor in parallel.

With the above-described configuration, a parallel circuit of the inductor and the capacitor is capacitive in a high band, and a frequency of ¾ wavelength resonance of the low-band antenna element can be made higher than the high band. Therefore, the low-band antenna element does not ¾ wavelength-resonate in the high band and loss is reduced, thereby preventing deterioration in efficiency in the high band. Even when the low-band antenna element ¾λ-resonates in the high band, a high-band current passes through not only the antenna-shortening inductor but also the capacitor. Therefore, the loss that is generated in the antenna-shortening inductor can be reduced.

(2) The antenna device can include a ground conductor enlarged in a planar manner, and the high-band antenna element and the low-band antenna element be formed in a non-ground region close to an edge of the ground conductor. In the antenna device having this configuration, lowering of antenna efficiency in the high band due to an unnecessary resonance current that flows through the ground conductor is significant. However, with the configuration described in the above-described (1), the above-described loss reduction effect is enhanced even when the ground conductor makes close to the high-band antenna element and the low-band antenna element. The ground conductor acts as a part of a radiation element with a necessary current flowing through the ground conductor, and the antenna efficiency is increased.

(3) The antenna-shortening inductor can be configured by a plurality of inductors connected in series and a switch for switching a current path to the plurality of inductors can be provided. With this configuration, the inductance of the above-described inductor is switched to switch the shortening rate of the low-band antenna element, thereby covering a wide range of the resonant frequency in the low band.

(4) In the above-described (3), at least a part of the capacitor can be configured in the switch. With this configuration, the capacitor that is added other than the switch can be omitted, thereby reducing the mounting area and the size.

(5) In the above-described (3) or (4), the plurality of inductors can be arranged in a meander form. With this arrangement, the length of a path for connecting the capacitor is made short to increase an own resonant frequency of the capacitor. Accordingly, an efficiency improvement effect can be enhanced.

(6) In the above-described (3) or (4), the plurality of inductors can be arranged in a helical form. With this arrangement, the length of a path for connecting the capacitor is made short to increase an own resonant frequency of the capacitor. Accordingly, an efficiency improvement effect can be enhanced.

(7) A communication apparatus according to another aspect of the present disclosure includes the antenna device according to any one of the above-described (1) to (6), and a communication circuit that is connected to the antenna device.

According to the present disclosure, unnecessary resonance of a low-band antenna element in a high band can be suppressed and loss is reduced to prevent deterioration in antenna efficiency in the high band.

BRIEF DESCRIPTION OF THE SEVERAL VIEWS OF THE DRAWINGS

FIGS. 8A-8D are four orthogonal views illustrating an example of the mounting configuration of a capacitor and four inductors on the printed wiring board 9.

DETAILED DESCRIPTION

<<First Embodiment>>

Figure 1:
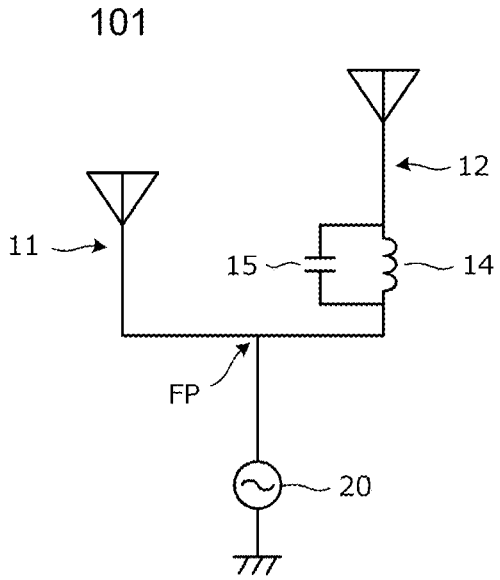
FIG. 1 is a circuit diagram of an antenna device 101 according to a first embodiment.
Figure 2:
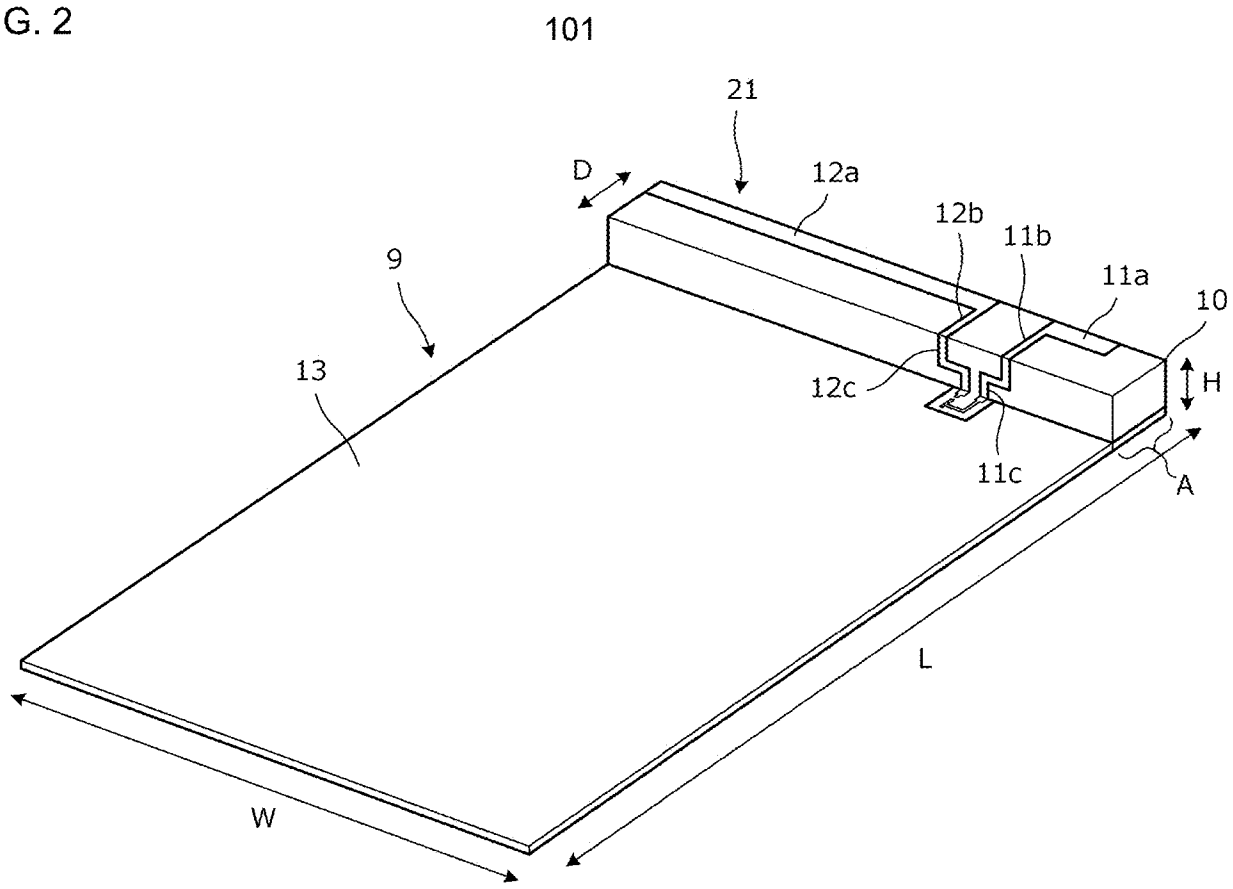
FIG. 2 is a perspective view of the antenna device 101.

FIG. 1 is a circuit diagram of an antenna device 101 according to a first embodiment. FIG. 2 is a perspective view of the antenna device 101. The antenna device 101 includes a high-band antenna element 11 and a low-band antenna element 12. The high-band antenna element 11 and the low-band antenna element 12 are connected to a common feed point FP. An antenna-shortening inductor 14 is connected to between the low-band antenna element 12 and the feed point FP. Furthermore, a capacitor 15 is connected to the antenna-shortening inductor 14 in parallel.

In the present disclosure, a high band is a frequency band of approximately equal to or higher than 1.5 GHz and a low band is a frequency band of approximately equal to or lower than 1 GHz.

It should be noted that the antenna-shortening inductor has a function of changing the length of the antenna element without necessarily changing the physical length of the antenna element.

A specific configuration example is as illustrated in FIG. 2. In this example, conductor patterns 11*a*, 11*b*, and 11*c* and conductor patterns 12*a*, 12*b*, and 12*c* are formed on the surface of a dielectric substrate 10 having a rectangular parallelepiped shape. The dielectric substrate 10 and the conductor patterns 11*a*, 11*b*, 11*c*, 12*a*, 12*b*, and 12*c* configure a chip antenna 21.

The high-band antenna element is configured by the above-described conductor patterns 11*a*, 11*b*, and 11*c* and the dielectric substrate 10 and the low-band antenna element is configured by the conductor patterns 12*a*, 12*b*, and 12*c* and the dielectric substrate 10.

A ground conductor 13 is formed on a printed wiring board 9. The chip antenna 21 is mounted in a ground conductor non-formation region (non-ground region) A of the printed wiring board 9.

The conductor patterns 11*a*, 11*b*, 12*a*, and 12*b* are formed on the upper surface of the dielectric substrate 10 and the conductor patterns 11*c* and 12*c* are formed on the side surface of the dielectric substrate 10. Conductor patterns formed on the printed wiring board 9 are connected to the conductor patterns 11*c* and 12*c* in a state in which the chip antenna 21 is mounted on the printed wiring board 9.

Figure 3:
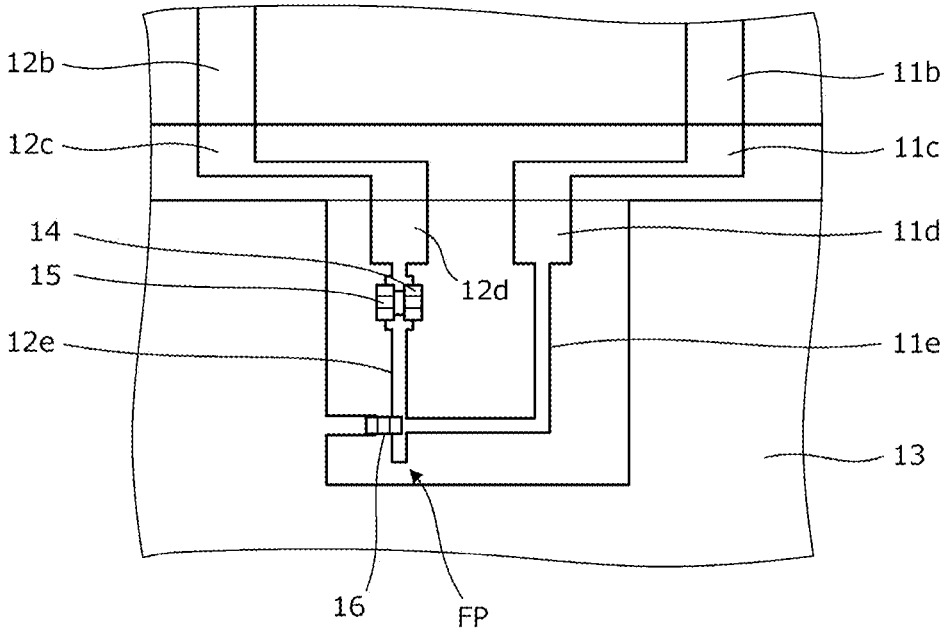
FIG. 3 is a partial perspective view illustrating the configuration of a connection portion between conductor patterns on a printed wiring board 9 and a chip antenna 21.

FIG. 3 is a partial perspective view illustrating the configuration of a connection portion between the conductor patterns on the printed wiring board 9 and the chip antenna 21. It should be noted that a point of view of FIG. 3 is different from that of FIG. 2. Conductor patterns 11*d*, 11*e*, 12*d*, and 12*e* are formed on the printed wiring board 9. An end portion of the conductor pattern 11*c* of the chip antenna is connected to the conductor pattern 11*d*. An end portion of the conductor pattern 12*c* of the chip antenna is connected to the conductor pattern 12*d*.

The antenna-shortening inductor 14 and the capacitor 15 are mounted between the conductor pattern 12*d* and the conductor pattern 12*e*. That is to say, a parallel circuit of the antenna-shortening inductor 14 and the capacitor 15 is connected in series between the conductor pattern 12*d* and the conductor pattern 12*e*.

The conductor pattern 11*e* and the conductor pattern 12*e* are commonly connected at the feed point FP. A power feeding circuit (see, a reference numeral 20 in FIG. 1) is connected between the feed point FP and the ground conductor 13. In FIG. 3, the power feeding circuit is omitted. It should be noted that a chip inductor 16 for impedance matching is mounted between the feed point FP and the ground conductor 13.

In the antenna device 101 in the embodiment, the parallel circuit of the inductor 14 and the capacitor 15 is capacitive in the high band and a frequency of ¾λ resonance of the low-band antenna element 12 can be made higher than the high band. Therefore, the low-band antenna element 12 does not ¾λ-resonate in the high band. As a result, loss in the high band is reduced to prevent deterioration in efficiency in the high band.

Figures 4A, 4B:
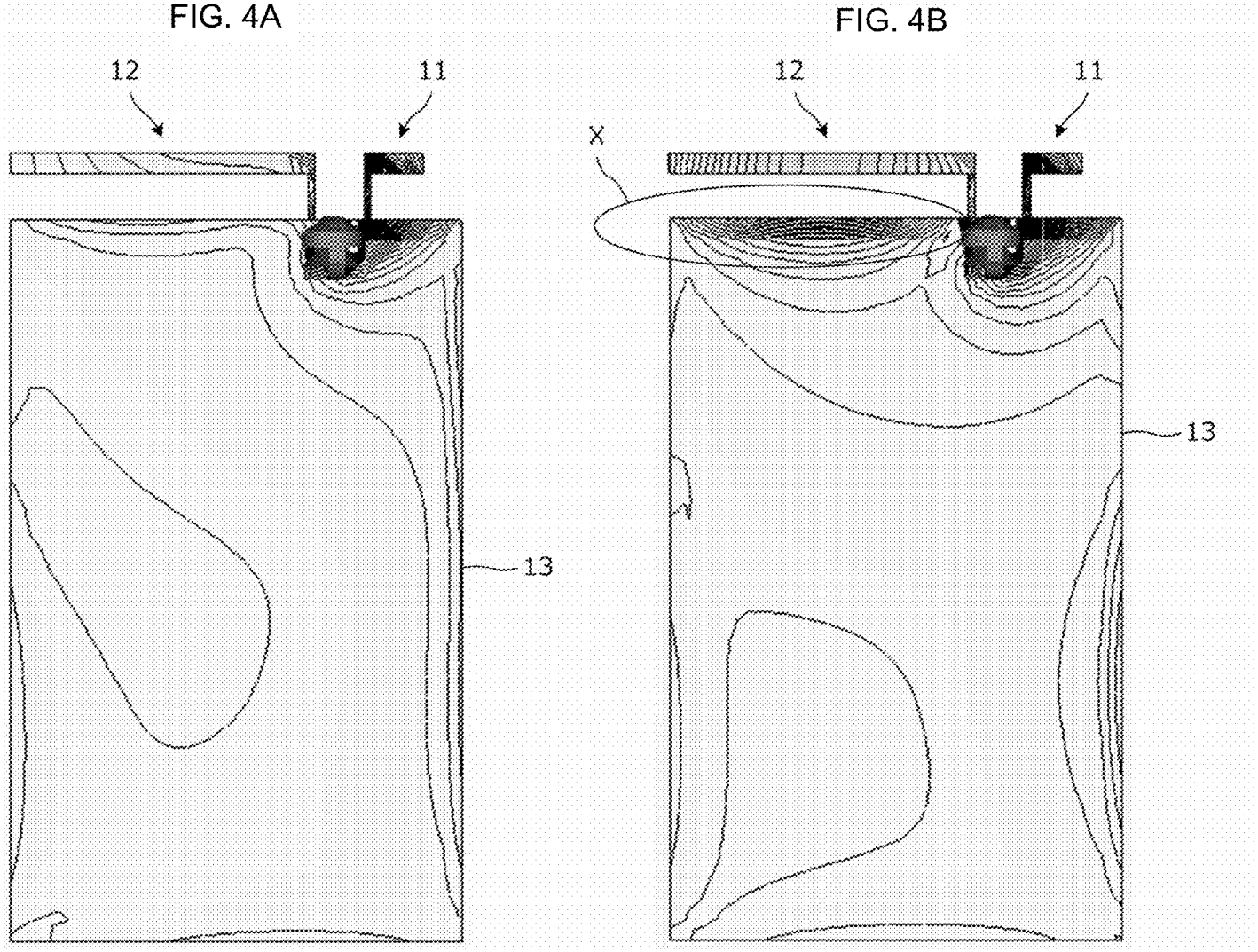
FIG. 4A is a view illustrating distribution of current intensity of the antenna device in the embodiment and FIG. 4B is a view illustrating distribution of current intensity of an antenna device in a comparative example.

Next, characteristics of the antenna device in the embodiment and characteristics of an antenna device in a comparative example are described. FIG. 4A is a view illustrating distribution of current intensity of the antenna device in the embodiment and FIG. 4B is a view illustrating distribution of current intensity of the antenna device in the comparative example. Both of them illustrate simulation results in the high band (2.14 GHz). Dimensions of respective components in FIG. 2 are defined as follows for simulation models.

W: 70 mm
L: 120 mm
D: 10 mm
H: 7 mm

The antenna device in the comparative example is different from the antenna device in the embodiment in a point that the capacitor 15 is not included.

As is indicated in FIG. 4B, the low-band antenna element 12 is excited by ¾λ resonance in the antenna device in the comparative example. The ¾λ resonance of the low-band antenna element 12 causes a current having a reverse phase to a radiation electrode to flow through (leak to) the ground conductor 13 (a portion indicated by X in FIG. 4B). Therefore, an electromagnetic field formed by the current flowing through the ground conductor 13 and an electromagnetic field formed by the current flowing through the antenna element 12 are cancelled by each other. Accordingly, the antenna efficiency in the high band is low. On the other hand, as is indicated in FIG. 4A, the low-band antenna element 12 does not ¾λ-resonate in the antenna device in the embodiment. Therefore, no current having the reverse phase to the radiation electrode flows through (leaks to) the ground conductor 13, thereby suppressing lowering of the efficiency in the high band. Furthermore, the ground conductor acts as a part of the radiation element with a current having a phase that is not reverse to the radiation electrode, which flows through the ground conductor, thereby increasing the antenna efficiency.

Figure 11:
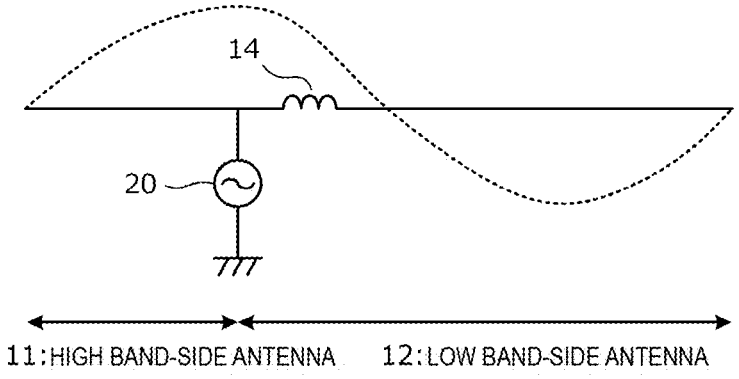
FIG. 11 is a reference diagram illustrating distribution of an electric current flowing through a high-band antenna element 11 and a low-band antenna element 12 in a state in which the low-band antenna element 12 ¾λ-resonates.

Increase in loss due to the ¾λ resonance of the low-band antenna element 12 also occurs by the following action. FIG. 11 is a diagram illustrating distribution of a current flowing through the high-band antenna element 11 and the low-band antenna element 12 in a state in which the low-band antenna element 12 ¾λ-resonates. A dashed line in FIG. 11 indicates current intensity. As is obvious from FIG. 11, the antenna-shortening inductor 14 is located at a position with high current intensity of a ¾λ resonance current of the low-band antenna element 12, that is, a large current flows through the antenna-shortening inductor 14. Therefore, large loss is generated in the antenna-shortening inductor 14.

Figure 5:
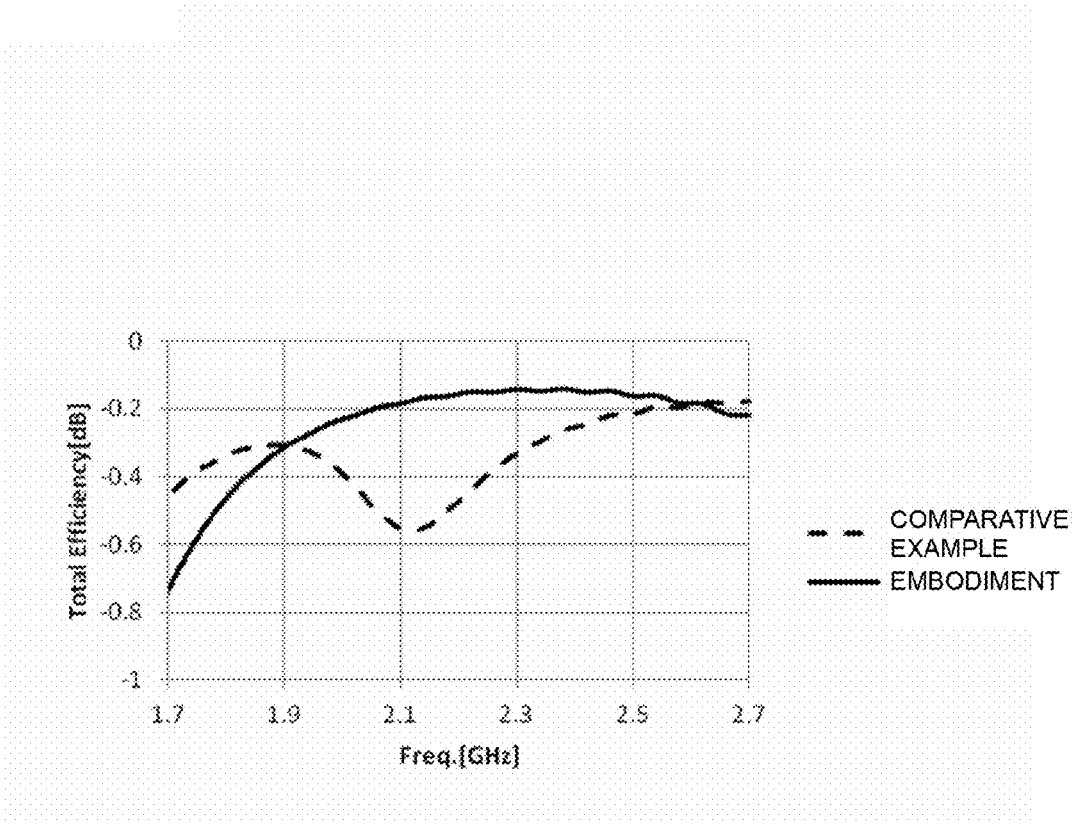
FIG. 5 is a characteristic diagram of antenna efficiency for the antenna device 101 in the embodiment and the antenna device in the comparative example.

FIG. 5 is a characteristic diagram of the antenna efficiency for the antenna device 101 in the embodiment and the antenna device in the comparative example. In comparative example, the antenna efficiency is obviously lowered at 2.14 GHz. This is because an unnecessary resonance current flows through the above-described ground conductor 13 and the ¾λ resonance current generated in the low-band antenna element 12 flows through the antenna-shortening inductor 14.

According to the embodiment, no unnecessary resonance current flows through the above-described ground conductor 13 and no current concentration occurs in the antenna-shortening inductor 14. Therefore, high antenna efficiency is provided in the high band.

<<Second Embodiment>>

Figure 6:
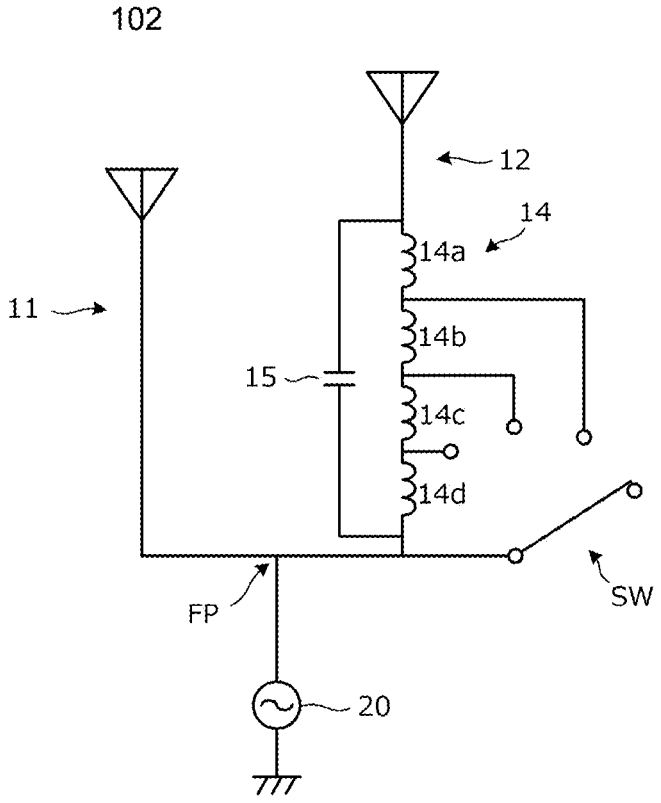
FIG. 6 is a circuit diagram of an antenna device 102 according to a second embodiment.

FIG. 6 is a circuit diagram of an antenna device 102 according to a second embodiment. In the embodiment, the antenna-shortening inductor 14 is configured by a plurality of inductors 14*a*, 14*b*, 14*c*, and 14*d* connected in series. A switch SW for switching a current path to the plurality of inductors 14*a*, 14*b*, 14*c*, and 14*d* is provided. Other configurations are as described in the first embodiment.

The inductance of the antenna-shortening inductor 14 can be changed by switching the switch SW illustrated in FIG. 6. Accordingly, switching of the switch SW can control a shortening effect of the low-band antenna element. This control enables band widening in the low band by switching the resonant frequency of the low-band antenna element 12.

<<Third Embodiment>>

Figure 7A:
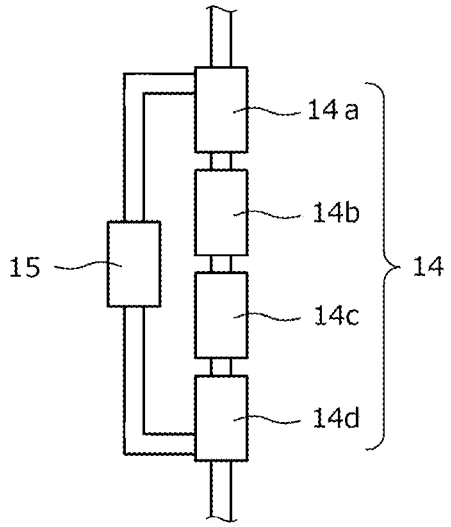
FIGS. 7A and 7B are diagrams illustrating the connection configuration of an antenna-shortening inductor 14 and a capacitor 15 that are connected between a low-band antenna element and a feed point of an antenna device according to a third embodiment.
Figure 7B:
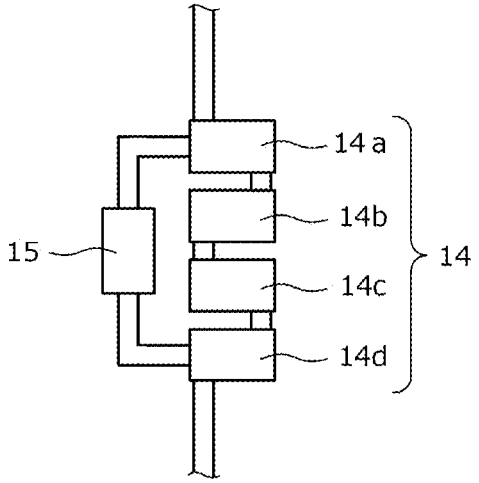

FIGS. 7A and 7B are diagrams illustrating the connection configuration of the antenna-shortening inductor 14 and the capacitor 15 that are connected between a low-band antenna element and a feed point of an antenna device according to a third embodiment. In both of the drawings, the antenna-shortening inductor 14 is configured by a serially connected circuit of the four inductors 14*a*, 14*b*, 14*c*, and 14*d*. The connection configuration of the antenna-shortening inductor 14 and the capacitor 15 is applied to the antenna device described in the second embodiment.

In an example illustrated in FIG. 7B, the four inductors 14*a*, 14*b*, 14*c*, and 14*d* are arranged in a meander form. With this arrangement, the length of a path for connecting the capacitor 15 is made short to decrease the inductance of the path for connecting the capacitor 15. As a result, a self-resonant frequency by the capacitor and the above-described path is increased. This causes a frequency band in which the parallel circuit of the inductor 14 and the capacitor 15 is capacitive to be widened, thereby providing an efficiency improvement effect in a wider band.

FIGS. 8A-8D are four orthogonal views illustrating an example of the mounting configuration of a capacitor and four inductors on the printed wiring board 9. The configuration of the printed wiring board 9 is as illustrated in FIG. 2 in the first embodiment.

In the example of FIGS. 8A-8D, the inductors 14*a* and 14*b* and the inductors 14*c* and 14*d* are respectively connected with via conductors formed in the printed wiring board 9 and the inductors 14*b* and 14*c* are connected with a conductor pattern on the back surface of the printed wiring board 9. Thus, the four inductors 14*a*, 14*b*, 14*c*, and 14*d* are arranged in a helical form. With this arrangement, not only the length of a path for connecting the capacitor 15 to the antenna-shortening inductor is made short but also the length of a path for connecting the four inductors 14*a*, 14*b*, 14*c*, and 14*d* is made short. This causes a frequency band in which the parallel circuit of the antenna-shortening inductor (14*a*, 14*b*, 14*c*, and 14*d*) and the capacitor 15 is capacitive to be widened, thereby providing an efficiency improvement effect in a wider band.

<<Fourth Embodiment>>

Figure 9:
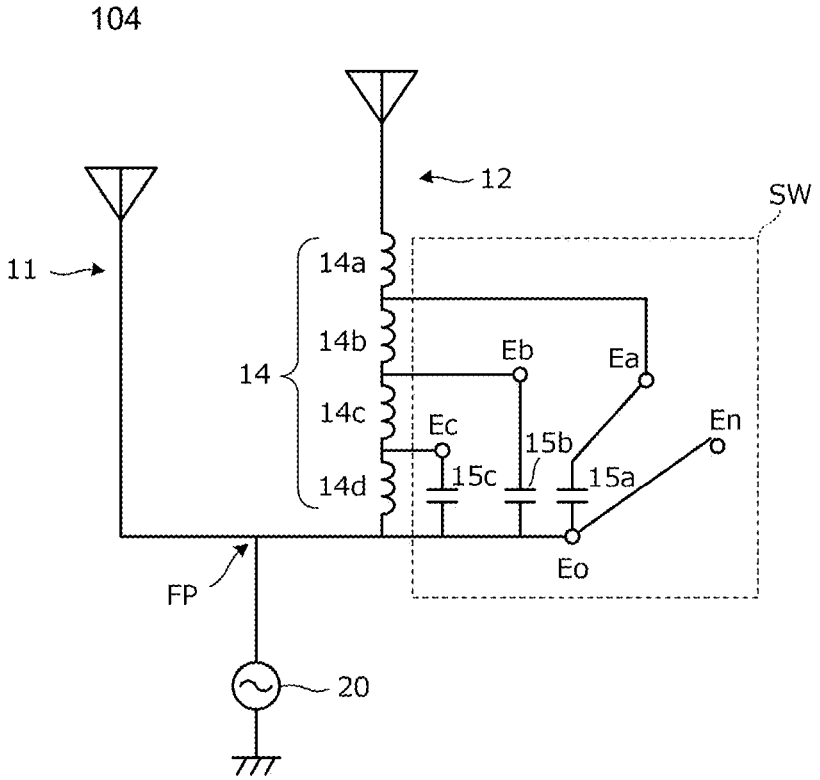
FIG. 9 is a circuit diagram of an antenna device 104 according to a fourth embodiment.

FIG. 9 is a circuit diagram of an antenna device 104 according to a fourth embodiment. In the embodiment, the antenna-shortening inductor 14 is configured by the plurality of inductors 14*a*, 14*b*, 14*c*, and 14*d* connected in series. The switch SW for switching the current path to the plurality of inductors 14*a*, 14*b*, 14*c*, and 14*d* is provided. Unlike the second embodiment, a capacitance that is generated in the switch SW is used as a capacitor connected to the antenna-shortening inductor 14 in parallel in the embodiment. That is to say, the capacitor is configured by a part of the switch SW. Other configurations are as described in the second embodiment.

The switch SW is formed by a field-effect transistor (FET) switch IC, and a terminal Eo and any of terminals Ea, Eb, Ec, and En are selectively conducted. Capacitances are generated between non-selected terminals and the terminal Eo. For example, when the terminal Ea is selected, capacitors 15*b* and 15*c* are generated. For example, when the terminal En is selected, capacitors 15*a*, 15*b*, and 15*c* are generated.

This configuration can omit a capacitor that is added other than the switch SW, thereby reducing the mounting area and the size.

The configuration in the SW may be defined such that capacitances (off-capacitances) which are generated in the above-described non-selected terminals are positively increased by providing a capacitance formation pattern in the switch IC.

Furthermore, not all but a part of the capacitors that are connected to the antenna-shortening inductor 14 in parallel may be configured in the switch SW.

When a shift amount of the frequency of the ¾λ resonance of the low-band antenna element 12 to a higher band by the capacitor 15 is small, the low-band antenna element 12 ¾λ-resonates in the high band in some cases. Even in this case, a high-band current passes through not only the antenna-shortening inductor 14 but also the capacitor, thereby reducing the loss that is generated in the antenna-shortening inductor 14. Accordingly, the loss in the high band is reduced, thereby preventing deterioration in the efficiency in the high band.

<<Fifth Embodiment>>

In a fifth embodiment, an example of a communication apparatus is described.

Figure 10:
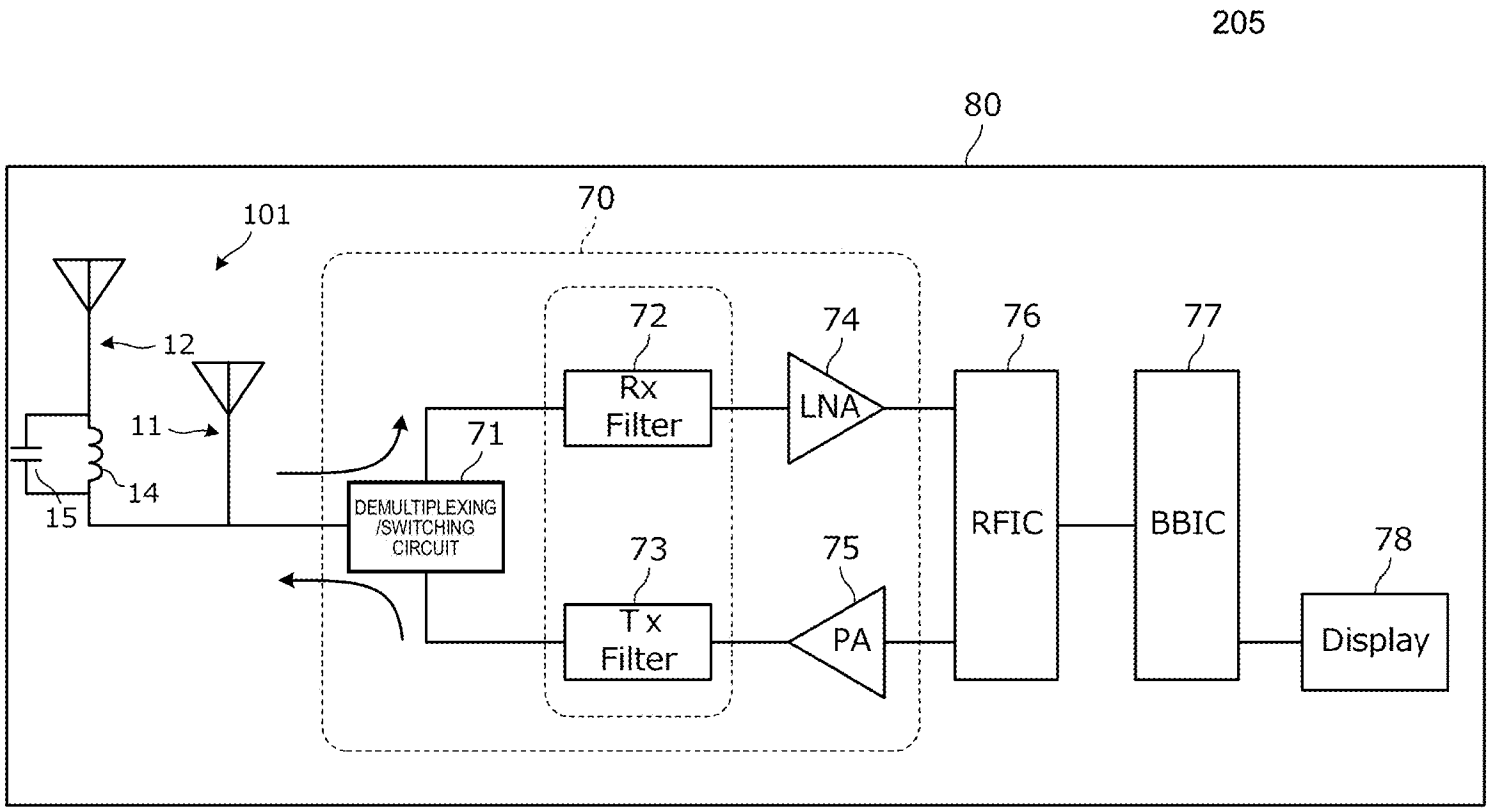
FIG. 10 is a block diagram of a communication apparatus 205 according to a fifth embodiment.

FIG. 10 is a block diagram of a communication apparatus 205 according to a fifth embodiment. The communication apparatus 205 is, for example, a cellular phone terminal. The configuration of the antenna device 101 is the same as the antenna device 101 described in the first embodiment. A demultiplexing/switching circuit 71 is connected to the antenna device 101. A low-noise amplifier 74 is provided between a radio frequency integrated circuit (RFIC) 76 and a reception filter 72 and a power amplifier 75 is provided between the RFIC 76 and a transmission filter 73. The RFIC 76 and a display device 78 are connected to a baseband IC 77. The demultiplexing/switching circuit 71, the reception filter 72, the transmission filter 73, the low-noise amplifier 74, and the power amplifier 75 are configured as one RF front-end circuit (one module component) 70. The above-described components are provided in a housing 80. The RF front-end circuit 70 and the RFIC 76 are examples of a "communication circuit" according to the present disclosure.

The baseband IC 77 or the RFIC 76 switches the switch SW when, for example, the antenna device 102 as illustrated in FIG. 6 is provided instead of the antenna device 101 illustrated in FIG. 10.

Finally, descriptions of the above-described embodiments are examples in all points and are not limiting. Those skilled in the art can appropriately deform and change the above-described embodiments. For example, partial replacement or combination of the configurations described in different embodiments can be made. The range of the present invention is indicated not by the above-described embodiments but by the scope of the claims of the invention. Furthermore, the range of the present invention is intended to encompass all the changes within the equivalent meaning and range of the scope of the claims of the invention.

Reference Signs List

FP FEED POINT
SW SWITCH
9 PRINTED WIRING BOARD
10 DIELECTRIC SUBSTRATE
11 HIGH-BAND ANTENNA ELEMENT
11*a*, 11*b*, 11*c*, 11*d*, 11*e* CONDUCTOR PATTERN
12 LOW-BAND ANTENNA ELEMENT
12*a*, 12*b*, 12*c*, 12*d*, 12*e* CONDUCTOR PATTERN
13 GROUND CONDUCTOR
14 ANTENNA-SHORTENING INDUCTOR
14*a*, 14*b*, 14*c*, 14*d* INDUCTOR
15 CAPACITOR
16 CHIP INDUCTOR
15*a*, 15*b*, 15*c* CAPACITOR
21 CHIP ANTENNA
70 RF FRONT-END CIRCUIT
71 DEMULTIPLEXING/SWITCHING CIRCUIT
72 RECEPTION FILTER
73 TRANSMISSION FILTER
74 LOW-NOISE AMPLIFIER
75 POWER AMPLIFIER
76 RFIC
77 BASEBAND IC
78 DISPLAY DEVICE
80 HOUSING
101, 102, 104 ANTENNA DEVICE

The invention claimed is:

1. An antenna device comprising:
a high-band antenna element and a low-band antenna element that are connected to a common feed point;
an antenna-shortening inductor that is connected between the low-band antenna element and the feed point; and
a capacitor that is connected to the antenna-shortening inductor in parallel.

2. The antenna device according to claim 1, including a ground conductor extended in a planar manner,
wherein the high-band antenna element and the low-band antenna element are formed in a non-ground region at an edge of the ground conductor.

3. The antenna device according to claim 2,
wherein the antenna-shortening inductor comprises a plurality of inductors connected in series and a switch that switches a current path to the plurality of inductors.

4. A communication apparatus comprising:
an antenna device; and
a communication circuit that is connected to the antenna device,
wherein the antenna device is the antenna device according to claim 2.

5. The antenna device according to claim 1,
wherein the antenna-shortening inductor comprises a plurality of inductors connected in series and a switch that switches a current path to the plurality of inductors.

6. The antenna device according to claim 5,
wherein the switch comprises at least a part of the capacitor.

7. The antenna device according to claim 6,
wherein the plurality of inductors are arranged in a meander form.

8. The antenna device according to claim 6,
wherein the plurality of inductors are arranged in a helical form.

9. A communication apparatus comprising:
an antenna device; and a communication circuit that is connected to the antenna device, wherein the antenna device is the antenna device according to claim 6.

10. The antenna device according to claim 5, wherein the plurality of inductors are arranged in a meander form.

11. A communication apparatus comprising:

an antenna device; and a communication circuit that is connected to the antenna device, wherein the antenna device is the antenna device according to claim 10.

12. The antenna device according to claim 5, wherein the plurality of inductors are arranged in a helical form.

13. A communication apparatus comprising:

an antenna device; and a communication circuit that is connected to the antenna device, wherein the antenna device is the antenna device according to claim 12.

14. A communication apparatus comprising:

an antenna device; and a communication circuit that is connected to the antenna device, wherein the antenna device is the antenna device according to claim 5.

15. A communication apparatus comprising:

an antenna device; and a communication circuit that is connected to the antenna device, wherein the antenna device is the antenna device according to claim 1.

* * * * *